US005146847A

United States Patent [19]

Lyon et al.

[11] Patent Number: 5,146,847

[45] Date of Patent: Sep. 15, 1992

[54] VARIABLE SPEED FEED CONTROL AND TENSIONING OF A BANDER

[75] Inventors: Peter A. Lyon; Warren L. Gawve, both of Lockport, N.Y.

[73] Assignee: General Motors Corporation, Detroit, Mich.

[21] Appl. No.: 678,095

[22] Filed: Apr. 1, 1991

[51] Int. Cl.[5] ..... B65B 13/22

[52] U.S. Cl. ..... 100/2; 53/399; 53/589; 100/4; 100/26; 100/32; 226/42

[58] Field of Search ..... 100/2, 4, 26, 29, 32, 100/33 PB; 53/589, 399; 226/24, 42, 43, 49, 100, 122, 143

[56] References Cited

U.S. PATENT DOCUMENTS

| | | | |
|---|---|---|---|
| 3,061,534 | 10/1962 | Jasperson | 226/43 X |
| 3,232,217 | 2/1966 | Harmon et al. | 100/4 X |
| 3,420,158 | 1/1969 | Kobiella | 100/2 |
| 3,452,853 | 7/1969 | Mabon | 226/43 X |
| 3,866,812 | 2/1975 | Gutjahr . | |
| 3,946,921 | 3/1976 | Noguchi . | |
| 4,435,945 | 3/1984 | Röhrig . | |
| 4,595,433 | 6/1986 | Ford et al. . | |
| 4,691,498 | 9/1987 | Stamm | 100/32 X |
| 4,952,270 | 8/1990 | Sakaki et al. | 100/32 X |

FOREIGN PATENT DOCUMENTS

| | | | |
|---|---|---|---|
| 2355717 | 1/1978 | France | 100/33 PB |
| 951295 | 3/1964 | United Kingdom | 100/2 |

*Primary Examiner*—Harvey C. Hornsby
*Assistant Examiner*—Stephen F. Gerrity
*Attorney, Agent, or Firm*—Ronald L. Phillips

[57] ABSTRACT

A strap feed assembly wraps a flexible strap around an item. A drive wheel is connected to a reversible drive motor for feeding and reversing the strap to wrap the strap around the item and to tension the strap once it is wrapped therearound. A controller operates the drive motor to control the speed, acceleration, direction of rotation, and tensioning of the strap. The velocity and acceleration of the drive motor are varied depending on the nearness of completion of the feeding and tensioning. Variable tension is achieved by monitoring the current drawn by the drive motor and comparing same to predetermined values to stop reversal and therefore tensioning.

6 Claims, 5 Drawing Sheets

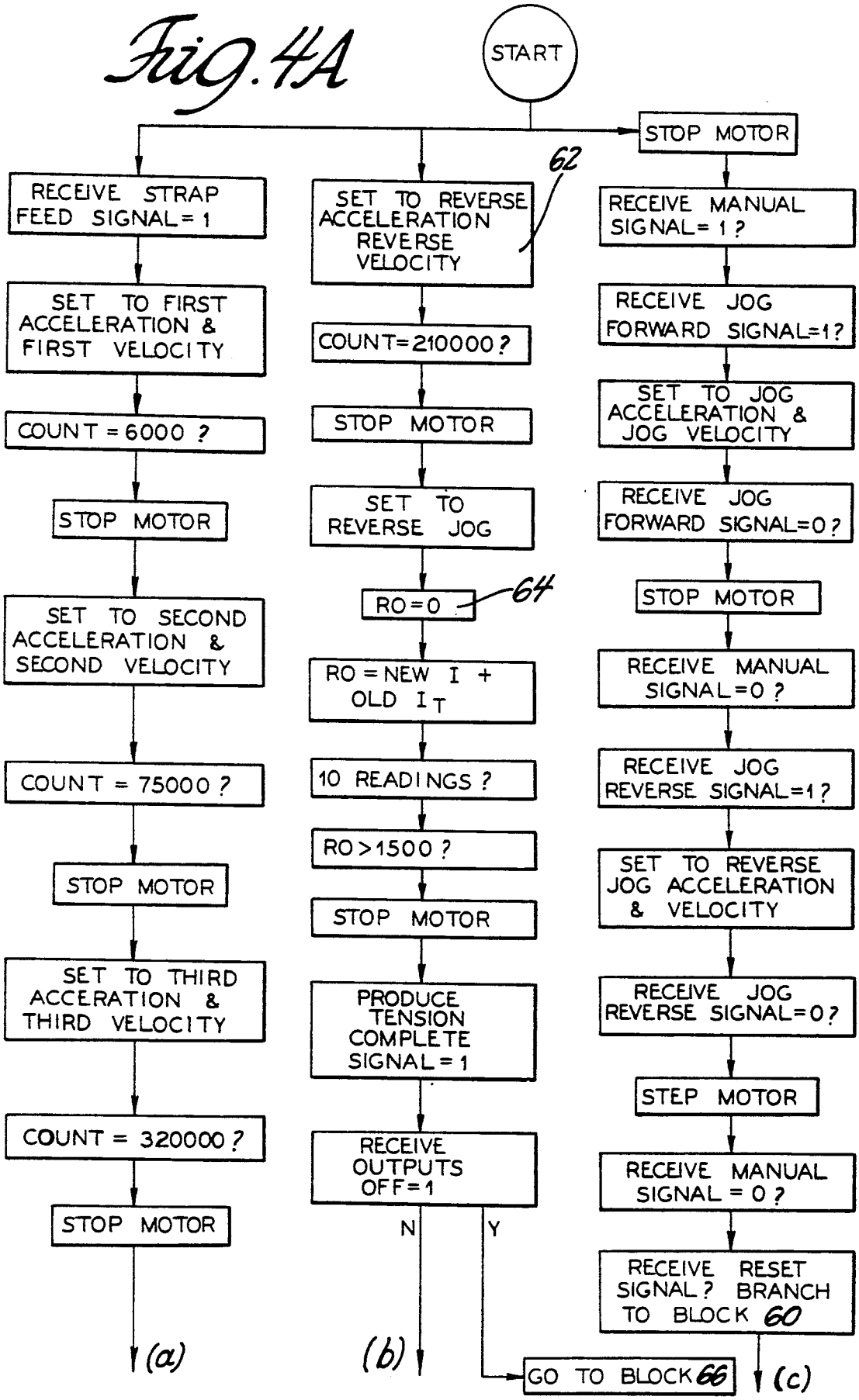
Fig. 4A
START
STOP MOTOR
RECEIVE STRAP FEED SIGNAL = 1
SET TO FIRST ACCELERATION & FIRST VELOCITY
COUNT = 6000 ?
STOP MOTOR
SET TO SECOND ACCELERATION & SECOND VELOCITY
COUNT = 75000 ?
STOP MOTOR
SET TO THIRD ACCERATION & THIRD VELOCITY
COUNT = 320000 ?
STOP MOTOR
(a)
SET TO REVERSE ACCELERATION REVERSE VELOCITY
62
COUNT = 210000 ?
STOP MOTOR
SET TO REVERSE JOG
RO = 0
64
RO = NEW I + OLD I T
10 READINGS ?
RO > 1500 ?
STOP MOTOR
PRODUCE TENSION COMPLETE SIGNAL = 1
RECEIVE OUTPUTS OFF = 1
N
Y
(b)
GO TO BLOCK 66
RECEIVE MANUAL SIGNAL = 1 ?
RECEIVE JOG FORWARD SIGNAL = 1 ?
SET TO JOG ACCELERATION & JOG VELOCITY
RECEIVE JOG FORWARD SIGNAL = 0 ?
STOP MOTOR
RECEIVE MANUAL SIGNAL = 0 ?
RECEIVE JOG REVERSE SIGNAL = 1 ?
SET TO REVERSE JOG ACCELERATION & VELOCITY
RECEIVE JOG REVERSE SIGNAL = 0 ?
STEP MOTOR
RECEIVE MANUAL SIGNAL = 0 ?
RECEIVE RESET SIGNAL ? BRANCH TO BLOCK 60
(c)

VARIABLE SPEED FEED CONTROL AND TENSIONING OF A BANDER

TECHNICAL FIELD

This invention relates to strap feed assemblies which include a drive wheel to feed a strap through a guide track about an item to be banded, and thereafter tensioning and crimping same.

BACKGROUND OF THE INVENTION

Current production strap feed assemblies include a drive wheel and idler wheels that are operated during a four cycle banding process. The cycles include a feed cycle wherein an electric drive motor is driven in a first direction to feed a strap through a track and around the item to be banded. The drive motor rotates a knurled drive wheel with respect to an idler wheel assembly that cooperates with the drive wheel to apply drive force during the feed and tension cycles. The drive motor is controlled to rotate in an opposite direction during a tension cycle wherein the strap is pulled in a direction opposite to the feed direction outwardly of the track and around the item to cause to tighten the strap around the item to be banded.

During the tension cycle, a greater drive force is applied on the strap by the idler wheel and drive wheel during the tension cycle. Once the tensioning is complete, leading and trailing strap portions are fastened together during a crimping cycle to create a sealed connection around the item to be banded. The strap is then severed during a cutting cycle to separate a sealed strap loop from the trailing portion of the strap material.

The control assemblies for controlling the motor operating the drive wheel, command motor operation to a single forward speed until a predetermined length is fed as measured by a detector at which point the drive wheel is stopped, the free end of the strap is gripped, and the drive wheel is reversed at a single reverse speed until an external tension cut off switch is actuated.

Current strap feed control assemblies include that shown in U.S. Pat. No. 3,946,921, issued Mar. 30, 1976 in the name of Noguchi. Such an assembly discloses a feed strap control assembly which operates the strap in the forward direction for a predetermined length, and then in a reverse direction for tension. The termination of tensioning is detected by stoppage of the floating roller and/or feed roller, or speed decrease of the motor.

Other banding control assemblies utilize mechanical clutches and/or simple electric limit switches and/or valves to control feed typically air, hydraulic, or simple electric motors. These are limited to running at a fixed speed, feeding a fixed amount of strap, and tensioning to a fixed value.

SUMMARY OF THE INVENTION

The invention includes a strap feed assembly and method for wrapping a flexible strap around an item. The assembly includes a drive wheel connected to a reversible drive motor for feeding and reversing the strap to wrap the strap around the item and to tension the strap once it has been strapped around the item. Strap detector means senses and produces a length signal indicative of the length of the strap fed by the drive motor. Controller means receives the length signal and controls the drive motor to a first predetermined feed speed and decreases the speed of the drive motor to a second predetermined feed speed upon detection of a first predetermined length of strap. The controller means stops and reverses the drive motor upon detection of a second predetermined length of strap.

The controller means controls the drive motor in a reverse direction at a first reverse speed for a first predetermined length of strap and then at a decreased second reverse speed to tension the strap.

The invention is further characterized by including tension detection means for monitoring the current draw of the drive motor producing a tension signal indicative of the tension on the strap. The controller means for reversing the drive motor to tension the strap, is operative to receive the aforesaid tension signal and to compare it with a predetermined tension value to stop the drive motor when the tension signal equals the predetermined tension value which is established in accordance with the type of item being banded. For example, if the item requires compression when fully strapped the predetermined tension valve might be greater than for an item which merely requires a minimal hoop/loop pressure.

BRIEF DESCRIPTION OF THE DRAWINGS

The invention will be better understood by reference to the detailed drawings wherein:

FIG. 4A–B are flowcharts of the motion controller of the subject invention.

DETAILED DESCRIPTION OF THE PREFERRED EMBODIMENT

Figure 1:
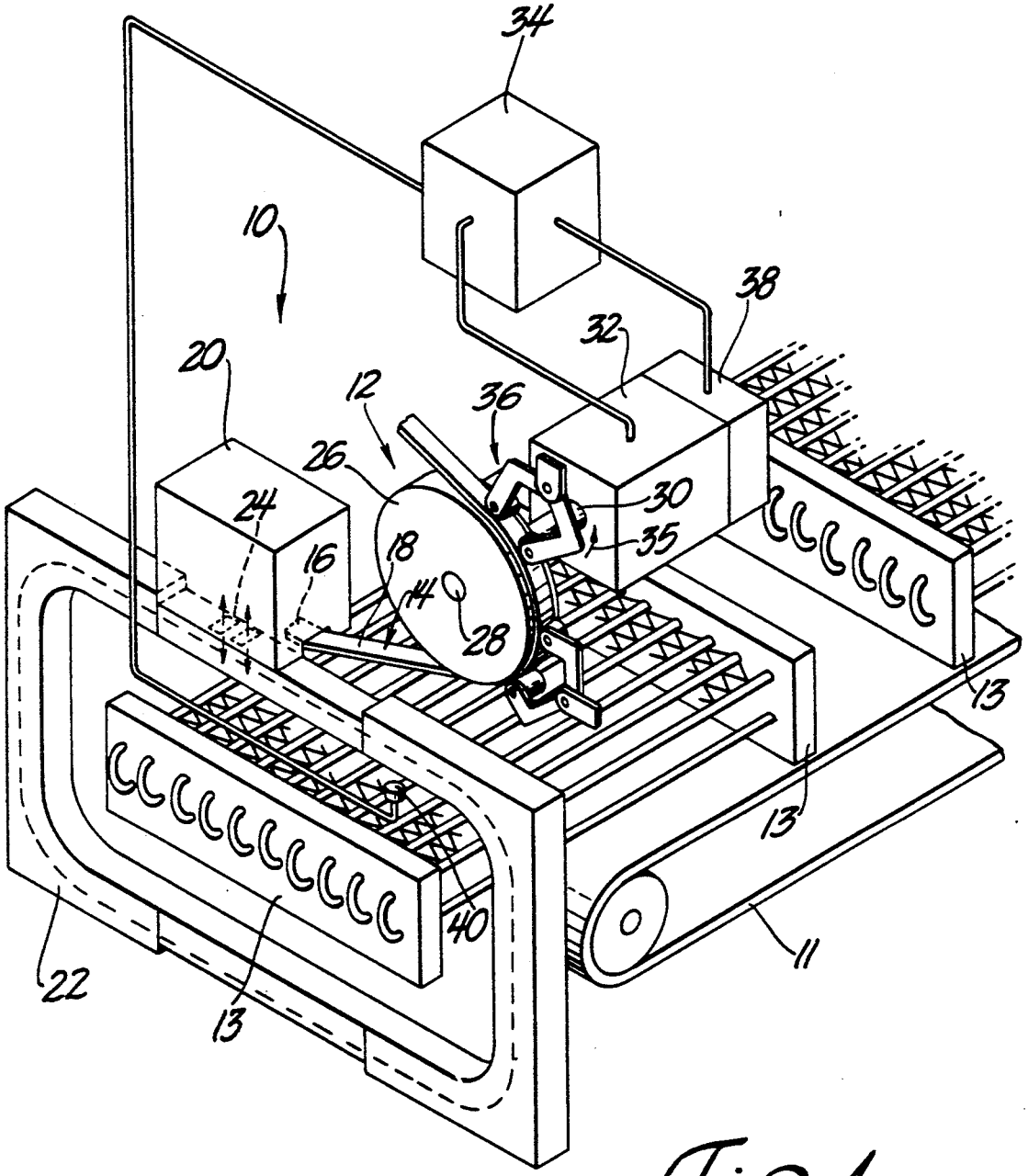
FIG. 1 is a perspective view of a strap feed assembly of the present invention.

Referring now to FIG. 1, a typical strap feed assembly 10 is illustrated for straddling a conveyor line 11 on which are located items 13 which are to be wrapped and banded by the assembly. The strap feed assembly 10 includes a feed head 12 with a guide track 14 through which the leading end 16 of a strap 18 can be fed from a roll of the strap material. The leading end 16 is guided from the track 14 through a clamping head 20 to be looped about the item as diagrammatically shown in FIG. 1. During the feed cycle, the leading end 16 is directed from the guide track 14, through a loop guide 22, and then through a track within the clamping head 20 where it is gripped by fingers 24. Set forth more particularly in copending U.S. application Ser. No. 670,625, filed Mar. 18, 1991, assigned to an assignee common to the assignee in the present application. The details of clamping head 20 in the aforesaid application are representative of one suitable clamping head and are incorporated herein by references. It should be understood, however, that other types of clamping heads are equally suited for use with the present invention.

The assembly 10 includes a drive wheel 26 connected to the outboard end of a shaft 28 supported at opposite ends. The inboard end of the shaft 28 is operatively connected to an output shaft 30 of a reversible electric drive motor 32. The drive motor 32 is a servo motor operating under the control of controller means 34, as will be subsequently discussed.

A force generating floating back-up wheel assembly 36 is configured to distribute the force of the back-up wheel assembly to reduce pressure loads on the strap during a tension cycle. The drive wheel 26 includes a knurled peripheral surface. The back-up wheel assembly 36 cooperates with the drive wheel 26 to apply a tension force against the strap 18 as it is wrapped around the item. Details of the back-up wheel assembly 36 and to operation are set forth in U.S. patent application Ser. No. 670,625, filed Mar. 18, 1991, also incorporated by reference and commonly assigned with the present application.

In one particular design, the back-up wheel assembly 36 includes four locating back-up wheels by independent floating spring suspensions (not shown) so as to attenuate tension forces on the strap 18 by spreading the area of strap on which the force is applied. As a consequence, the pressure on the strap is lowered such that the strap remains undeformed for consistent feed. At the same time, a tension force is maintained which is capable of compressing the item 18 during a tension cycle wherein the drive motor 32 is conditioned by the controller means 34 to be rotated in a counter clockwise direction 35 as viewed in FIG. 1. During such a tensioning cycle, the separate floating spring suspensions support multiple back-up wheels 36 so as to apply a tension force that is spread through more than 90 degrees on the periphery of the drive wheel 26.

The assembly 10 includes a strap length detector means 38 operatively connected with the drive motor 32 for producing a length signal indicative of the length of strap fed by the drive motor 32 and drive wheel 26. More particularly, the strap length detector means 38 comprises an encoder adapted to sense the position of the drive motor 32. The encoder 38 may be optical, contact, etc., for sensing the number of motor revolutions.

An end of strap detector 40 produces an end of strap signal upon detection of the presence of the leading end 16 of strap 18. The detector 40 is connected in the loop guide 22 prior to the strap reaching the clamping head 20. The detector 40 comprises a photoeye that is operative to sense the end 16 of the strap 18 forming a loop about the item 13 to be strapped or banded. The detector 40 verifies the presence of the strap 18 for indicating fault or misfeed.

In general, the controller means 34 receives the length signal and compares same to predetermined lengths to control the drive motor 32 at predetermined speeds feeding predetermined lengths of strap 18. The drive motor 32 is stopped, the end of the strap is gripped by fingers 24, and the drive motor 32 is the reversed. The controller means 34 monitors the reversing tension of the strap 18 about the item 13 and stops the drive motor 32 when the tension equals a predetermined tension.

Figure 2:
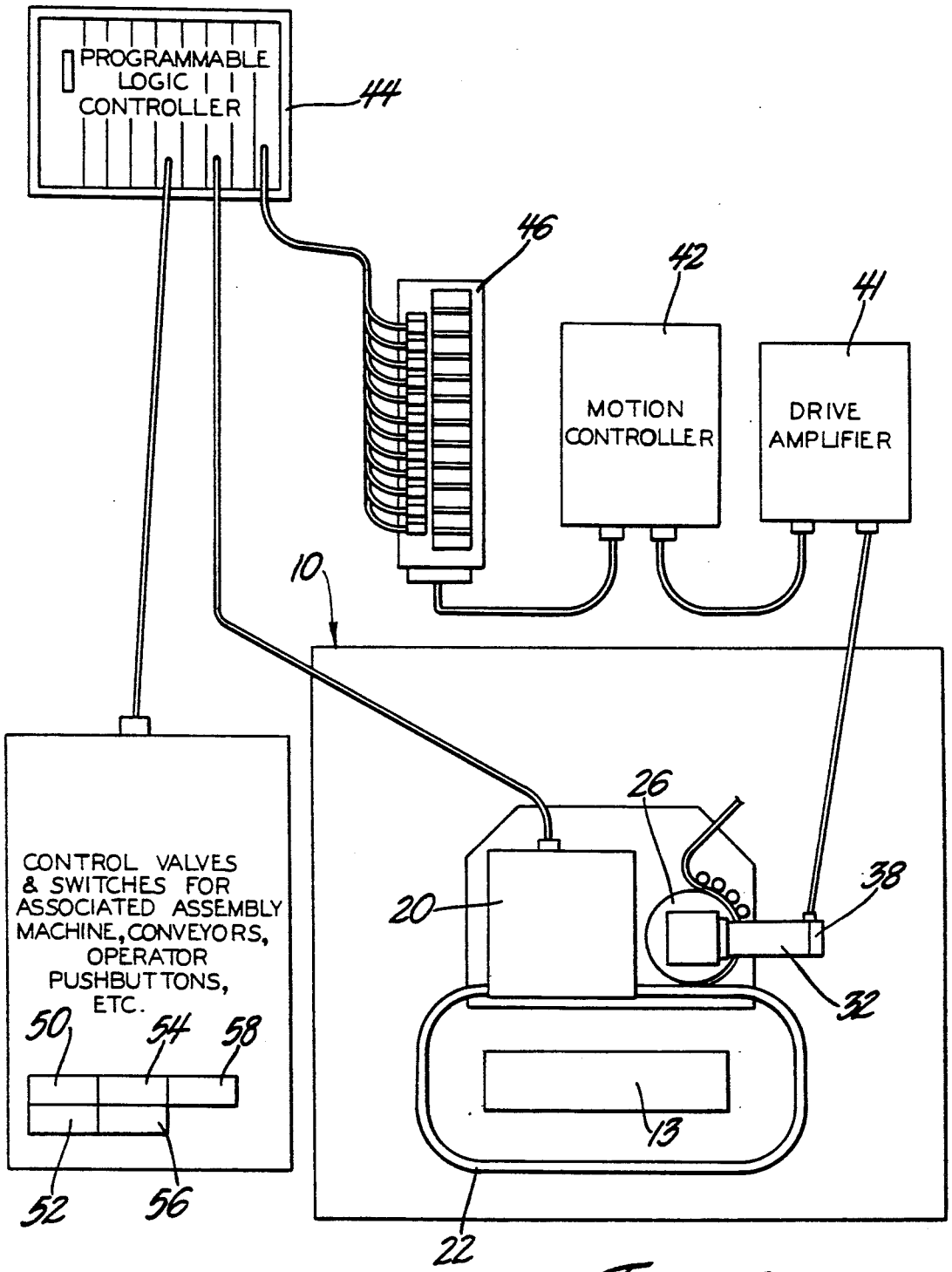
FIG. 2 is a block diagram of the controller of the subject invention.

The controller means 34 is more specifically illustrated in FIG. 2 and includes drive amplifier means 41, motion controller means 42, and bander control means 44. The drive amplifier means 41 is a servo drive amplifier and the motion controller means 42 is a motion controller, both manufactured by Ormec. The bander control means 44 is a programmable logic controller (PLC) manufactured by Allen Bradley of the type PLC 5/25 Controller. An interface 46 interconnects the PLC 44 and motion controller 42 for communicating the following signals therebetween: manual signal, jog reverse signal, jog forward signal, strap present signal, reset signal, outputs off signal, tension strap signal, feed strap signal, tension complete signal, and feed complete signal. The interface 46 is an optically isolated parallel interface, such as the type Opto-22.

The PLC 44 controls the bander sequencing and overall machine control. The PLC 44 is connected to the controls for the clamping head 20, controls for the conveyor line 11, operator push buttons and inputs, end of strap detector 40, and to the motion controller 42 through the interface 46. Inputs to the PLC44 include a start input key 50, reset input key 52, manual input key 54, jog forward input key 56, jog reverse input key 58.

The motion controller 42 accomplishes the feeding and tensioning. It receives sequence, function, and subroutine requests from the PLC 44, and actual servo motion programming resides within the motion controller 42. It is also connected to the strap length detector 38.

The motion controller 42 controls the position, velocity, acceleration and tensioning of the strap 18. During feeding of the strap 18 about the item 13, the velocity of the drive motor 32 is at a selected predetermined frequency until within a range of the full feeding. The speed is decreased until the remaining length of strap 18 has been fed to form the loop of strap about the item 13 at which point the feeding is stopped. The drive motor 32 acts as a traditional closed-loop servo by continuously monitoring its position and velocity to correct the drive amplifier output to minimize tracking error. Reversal of the strap is similar. A first reverse speed is used until within a range of the final tensioning, at which point deceleration occurs. When the tension reaches a predetermined value, the drive motor 32 is stopped. During tensioning, the motor 32 is in open-loop torque mode. The drive motor 32 is set to run at a predetermined speed until a predetermined motor current draw is detected indicative of a torque or tension at the drive wheel 26.

Tension is measured directly through the motor 32 without use of external devices or switches. This is accomplished by reading a 0–10 volt signal at the input of the drive amplifier 41. This voltage signal is proportional to the current being drawn by the drive motor 32 by the input resistance thereof. Motor current is proportional to the torque produced by the motor, and hence the tension transmitted to the strap 18. This analog control voltage is converted to a digital signal by an analog-to-digital converter, as commonly known in the art, and is directed to the motion controller 42. This value is used to complete the strap tension sequence by issuing a tension complete signal when a predetermined tension is reached. It should be understood that the reader for the 0–10 volt signal and the analog converter are embodied within the diagrammatically illustrated drive amplifier block 41.

Figure 3:
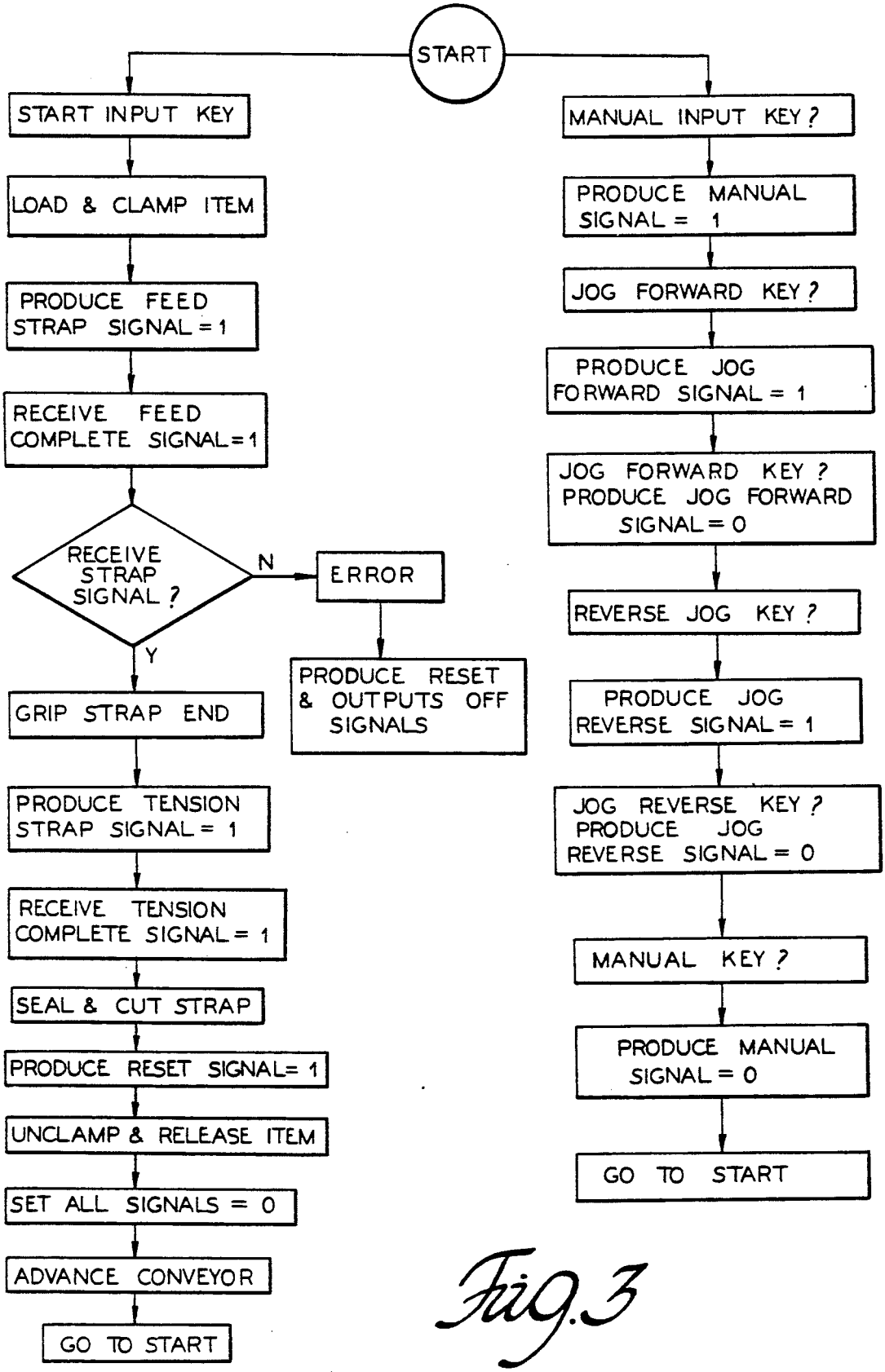
FIG. 3 is a flow chart of the control means of the subject invention.

The PLC 44 operates according to the flowchart in FIG. 3. The PLC 44 receives the start input from the operator to initiate a banding cycle. Upon reception thereof, the item 13 to be banded is loaded and clamped by the strap feed assembly 10. Thereafter, the PLC 44 produces the feed strap signal and directs it to the motion controller 42 and waits for the feed complete signal therefrom. Upon reception of the feed complete signal, the PLC 44 checks if it has received the strap signal indicating the end of strap 16 has been detected. If the strap signal is not received, the PLC 44 will indicate an error to inform the operator that a jam has occurred in the feeding process, and produces reset and outputs off signals. If the strap signal and feed complete signal are received, the PLC 44 instructs the clamping head 20 to grip the free end of the strap 16. Thereafter, the tension strap signal is produced by the PLC 44 and directed to the motion controller 42 and the PLC 44 waits for the tension complete signal therefrom. Upon reception of the tension complete signal, the strap 18 is crimped or otherwise sealed and cut as disclosed in copending Ser. No. 670,625, filed Mar. 18, 1991. The item 13 is then advanced to an unloading station by the conveyor line 11 while the next item is positioned for a succeeding banding operation as above set forth.

The PLC 44 may operate the strap feeding manually. Upon depression of the manual key input 54, a manual signal is transmitted to the motion controller 42. Upon depression of the jog forward key input 56, the jog forward signal is transmitted to the motion controller 42 for feeding the strap 18. The operator may visually determine when the desired amount of strap 18 has been fed and reset the jog forward key input 56 which in turn cancels the jog forward signal. The operator may then initiate gripping of the strap 18 in the prior art manner and reverse the strap by setting the jog reverse key input 58 which produces the jog reverse signal. When tensioning is complete, the resetting of the jog reverse key input 58 is set to eliminate the jog reverse signal. Upon depression of the manual key input 54, the manual signal is discontinued.

Figure 4B:
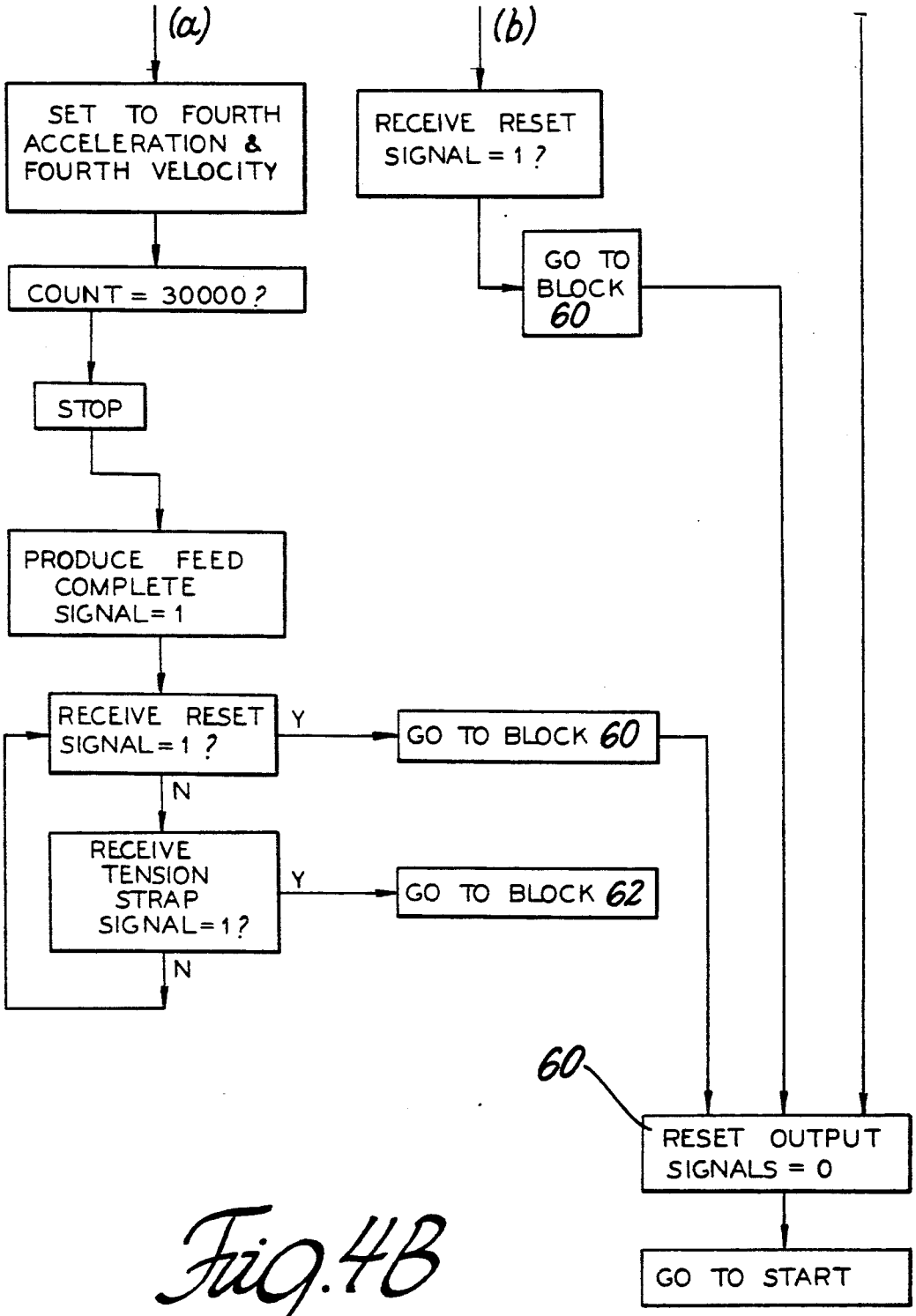

In one working embodiment in which the item to be banded is a tube and fin heat exchanger such as a motor vehicle radiator, the motion controller 42 utilizes the flowchart illustrated in FIGS. 4A–B. Upon receiving the feed strap signal, the drive motor 32 is accelerated at a first predetermined rate to a first predetermined velocity. The motion controller compares the length signal to predetermined lengths indicated by the count value from the encoder 38. Upon a count of 60000 counts from the encoder 38 for retracting the strap into the feed wheels 36, the feeding is stopped. Thereafter, the drive motor 32 is set to a second acceleration and second velocity until a count of 75000 is detected for feeding the strap 18 through the clamping head 20, and then stopped. The drive motor 32 is set to a third acceleration and third velocity until a count of 320000 is arrived for feeding the strap around the track, and then stopped. The drive motor 32 is set to a fourth acceleration and velocity until a count of 30000 for feeding the strap into the head. The drive motor 32 is stopped and the feed complete signal is produced. If a reset signal is received, the program branches to block 60 and if a tension strap signal is received, the program branches to block 62.

Upon reception of the tension signal, the drive motor 32 is set to a reverse acceleration and velocity until a count of 210000 counts is detected, and the drive motor 32 is stopped. Thereafter, the drive motor 32 is jogged to tension the strap. A temporary value RO is set to zero. The program then computes RO=new current reading+sum of old current reading. The program loops through this step nine times to obtain ten readings If the total current reading is greater than 1500, then the drive motor 32 is stopped. Otherwise the program branches to block 64 to repeat the tensioning steps. Upon satisfaction of the condition, the tension complete signal is produced. If the motion controller 42 receives the outputs off signal, the program branches to block 60. If the reset signal is received, the program branches to block 60.

The reset routine resets the outputs of the motion controller 42 and branches to the start of the program.

The motion controller 42 may also be operated in a manual mode as directed by the PLC 44. Upon reception of the manual set signal, the program branches to block 70. If the jog forward signal is received, the acceleration and velocity are set to predetermined values for jogging. The drive motor 32 will be operated until the absence of either the jog forward signal or manual signal. Upon reception of the jog reverse signal, the acceleration and velocity are set to reverse jog values. The drive motor 32 continues until the absence of the reverse or manual signals. Upon reception of the strap present signal, the motion controller 42 produces the feed complete signal. If the tension signal is received, the program branches to block 62. If the reset signal is received, the program branches to block 60.

The bulk of the velocity and acceleration signals are fed at a high rate. The motion controller 42 sends a control voltage to the drive motor 32, which voltage is proportional to the requested speed. However, it is desirable to feed or reverse the strap at slower rates when feeding the strap through the feed head, and when nearing full feed or tensioning. These slower rates would occur at the second and fourth velocity and acceleration, and the jogging speeds. Exemplary of such speeds include gross feed and retract=42 inches/-second; feed through tooling and straighten=28 inches/second; tension=1 inch/second.

With regard to the length of strap fed, the appropriate count value of the encoder 38 may be determined given the following constants: servo motor encoder count (W counts/revolution); gear reducer ratio (X:1); feed/tension wheel diameter (Y inches); required strap feed for radiator (Z inches). The calculated feed encoder count would be determined by: encoder counts=$(Z/(Y\times\pi)\times W\times X)$.

With regard to the strap tension, testing to obtain a graph of tension force vs. the current drawn by the motor 32 scaled to the motion controller 42 voltage settings may be developed. Alternatively, the value may be calculated from the following known constants: rated motor torque peak (302 in-lbs); gear reducer ratio (15:1); feed/tension wheel radius (4 inches); control voltages signal at torque peak (10 v); program value corresponding to 10 v control signal (Z units); required tension for radiator banding (88 lbs); system efficiency (66%). The calculated tension value would be determined by:

$$\text{Tension value}=[((302\times 15)(4)/Z]\times 88/0.66.$$

The above-described flowchart in FIG. 3B utilizes values relating to a particular radiator type. The motion controller 42 may store a plurality of values for different types of items 13 to be strapped, whereupon the PLC 44 may designate which set of value to use in the program control. The memory would store the strapping characteristics of reverse and forward lengths, forward and reverse speeds, and the predetermined tension. Therefore, a particular part type may be selected wherein its specific strapping characteristics associated therewith will also be selected and used for control.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A strap feed assembly for wrapping a flexible strap around an item including a drive wheel connected to a reversible variable speed drive motor for feeding and reversing the strap to wrap the strap around the item and to tension the strap once it is wrapped around the item, the improved comprising:

strap length detector means for continuously sensing the length of the strap fed by the drive wheel and producing a length signal indicative of the length of strap fed by the drive wheel;

controller means for storing first and second predetermined lengths of strap and for receiving said length signal and controlling the drive motor at a first forward predetermined speed, and for comparing the length of said length signal to said first predetermined length of strap and decreasing the speed of said drive motor to a second forward predetermined speed upon detection of said first predetermined length of strap, and for comparing the length of said length signal to a second predetermined length of strap and stopping and reversing the drive motor upon detection of said second predetermined length of strap.

2. A strap feed assembly for wrapping a flexible strap around an item including a drive wheel connected to a reversible electric drive motor for feeding and reversing the strap to wrap the strap around the item and to tension the strap once it is wrapped around the item, the improvement comprising:

tension detection means for monitoring current drawn from the drive motor to produce a tension signal indicative of the tension on the strap and torque by the drive motor; and controller means for controlling the drive motor in a forward direction for feeding the strap, and for reversing the drive motor to tension the strap around an item, receiving the tension representative of a measured tension and for comparing same to a predetermined tension to stop the drive motor when said tension signal equals said predetermined tension.

3. A strap feed assembly for wrapping a flexible strap around an item including a drive wheel connected to a reversible variable speed drive motor for feeding and reversing the strap to wrap the strap around the item and to tension the strap once it is wrapped around the item, the improvement comprising:

strap length detector means for continuously sensing the length of the strap fed by the drive wheel and producing a length signal indicative of the length of strap fed by the drive wheel;

controller means for receiving said length signal and controlling the drive motor in a forward direction to feed the strap around the item and for controlling the drive motor in a reverse direction at a first reverse speed for a first predetermined length of strap and comparing the length of said length signal to said first predetermined length of strap to control the drive motor at a decreased second reverse speed to tension the strap.

4. A method of wrapping a flexible strap around an item utilizing a drive wheel connected to a reversible variable speed drive motor for feeding and reversing the strap to wrap the strap around the item and to tension the strap once it is wrapped around the item, the method including the steps of:

continuously sensing and producing a length signal indicative of the length of strap fed by the drive wheel;

controlling the drive motor at a first forward predetermined speed, comparing the length of the length signal to a first predetermined length of strap, decreasing the speed of the drive motor to a second forward predetermined speed upon sensing of the first predetermined length of strap, comparing the length of the length signal to a second predetermined length of strap, and stopping and reversing the drive motor upon detection of the second predetermined length of strap.

5. A method of wrapping a flexible strap around an item utilizing a drive wheel connected to a reversible electric drive motor for feeding and reversing the strap to wrap the strap around the item and to tension the strap once it is wrapped around the item, the method including the steps of:

feeding the strap around the item, reversing the drive motor to tension the strap upon completion of the feeding, monitoring current drawn from the drive motor to produce a tension signal indicative of the tension on the strap and torque by the motor, comparing the tension of the tension signal to a predetermined tension, and stopping the drive motor when the tension signal equals the predetermined tension.

6. A method of wrapping a flexible strap around an item utilizing a drive wheel connected to a reversible variable speed drive motor for feeding and reversing the strap to wrap the strap around the item and to tension the strap once it is wrapped around the item, the method including the steps of:

feeding the strap around the item, continuously sensing and producing a length signal indicative of the length of strap fed by the drive motor;

reversing the drive motor at a first reverse speed for a first predetermined length of strap, comparing the length of the length signal to the first predetermined length of strap, and decreasing the speed of the drive motor to tension the strap upon sensing the first predetermined length of strap.

* * * * *